US005411930A

United States Patent [19]

Mizobuchi

[11] Patent Number: 5,411,930

[45] Date of Patent: May 2, 1995

[54] IMAGE-RECEIVING ELEMENT FOR PRODUCTION OF DYE DIFFUSION TYPE THERMAL TRANSFER IMAGE

[75] Inventor: Yoshikazu Mizobuchi, Madison, Wis.

[73] Assignee: Minnesota Mining and Manufacturing Company, St. Paul, Minn.

[21] Appl. No.: 51,537

[22] Filed: Apr. 22, 1993

[51] Int. Cl.[6] ..... B41M 5/035; B41M 5/38

[52] U.S. Cl. ..... 503/227; 428/195; 428/320.2; 428/913; 428/914

[58] Field of Search ..... 8/471; 428/195, 320.2, 428/913, 914, 212; 503/227

[56] References Cited

U.S. PATENT DOCUMENTS

| | | | |
|---|---|---|---|
| 4,555,427 | 11/1985 | Kawasaki et al. | 428/195 |
| 4,615,938 | 10/1986 | Hotta et al. | 428/323 |
| 5,001,106 | 3/1991 | Egashira et al. | 503/227 |

FOREIGN PATENT DOCUMENTS

| | | | |
|---|---|---|---|
| 2024586 | 8/1970 | France | 503/227 |
| 58-212994 | 10/1983 | Japan | 503/227 |
| 58-215398 | 12/1983 | Japan | 503/227 |
| 62-257888 | 11/1987 | Japan | 503/227 |
| 3-83691 | 4/1991 | Japan | 503/227 |
| 3-219996 | 9/1991 | Japan | 503/227 |
| 1299742 | 11/1968 | United Kingdom | 428/306.6 |

*Primary Examiner*—B. Hamilton Hess

*Attorney, Agent, or Firm*—Gary L. Griswold; Walter N. Kirn; Mark A. Litman

[57] ABSTRACT

An image-receiving element capable of forming an image of a thermally stable dye, to preclude a diffusion of the dye in the lateral direction after the formation of the image, and exhibiting an outstanding fastness ultraviolet light, is provided.

An image-receiving element comprising:

(1) a substrate;

(2) an open cell type porous film superposed on the surface of the substrate and formed of a material exhibiting a very low affinity for a dye; and (3) a polymer exhibiting a high affinity for a dye, possessing a glass transition point (Tg) of not lower than −5° C. and not higher than 40° C. and filling the pores of the porous film.

12 Claims, 21 Drawing Sheets

| Receptor | ΔEmax |
|---|---|
| —o— Vylon 290 | 68.03 |
| --Δ-- Vylon 200 | 65.01 |
| —□— Vitle PE307 | 68.52 |

(770-28 Film with #40 Meyer Bar)

| Receptor | ΔE max |
|---|---|
| —o— PVC | 72.87 |
| —o— Zeon400×150J | 66.21 |

On 770-28 with #40 Meyer Bar

| | |
|---|---|
| ---●--- PVC | 81.53 |
| ---●--- Zeon400×150J | 74.15 |

On 4mil PET with #10 Meyer Bar

| Receptor | ΔE max |
|---|---|
| —o— PVC | 79.07 |
| --Δ-- PVC+FC | 80.58 |
| —▽— PVC+Ph5 | 82.75 |
| --□-- PVC+Ph2.63 | 82.85 |
| --o-- PVC+Ph2.63+FC | 84.48 |

On 770-28 with #40 Meyer Bar

| Receptor | ΔE max |
|---|---|
| —o— PVC+FC | 81.36 |
| --△-- PVC+Ph2.63 | 86.67 |
| -·□·- PVC+Ph2.63+FC | 87.14 |
| ···o··· PVC+Ph5 | 87.50 |
| —▽— PVC+Ph5+FC | 86.69 |

On 4mil PET with #40 Meyer Bar

| Receptor | ΔE max |
|---|---|
| —o— 770-28 Film with #40 Meyer Bar | 71.68 |
| ---Δ--- 06101-5 Film with #20 Meyer Bar | 73.17 |
| ---□--- 770-28 Film with #40 Meyer Bar Dye Receiver:PVC Film | 52.85 |

| Receptor | ΔE max |
|---|---|
| GRL | 75.72 |
| #10 Meyer Bar on 4 mil PET Film | 75.31 |
| #10Meyer Bar | 69.08 |
| #20Meyer Bar | 72.39 |
| #40Meyer Bar | 77.69 |

Dye Receiver:PVC Film except GRL Receptor

| Receptor | ΔE max |
|---|---|
| —◇— GRL Receptor | 54.43 |
| --△-- #10Meyer Bar | 50.35 |
| —○— #20Meyer Bar | 51.60 |

On 770-28 Film

Dye Receiver:PVC Film except GRL Receiver

| Image | ΔE max |
|---|---|
| —o— Yellow | 69.22 |
| --Δ-- Magenta | 73.67 |
| --□-- Cyan | 41.45 |

Porous Receptor: PVC Film on 770-28 Porous Film with #40 Meyer Bar

| Image | ΔE max |
|---|---|
| —o— Y+M+C | 51.41 |
| ---Δ--- Y+M | 70.31 |
| —□— Y+C | 48.31 |
| ---o--- M+C | 70.29 |

Y:Yellow, M:Magenta, C:Cyan

Receptor:PVC Film on 770-28 Porous Film, with #40 Meyer Bar

| Receptor | ΔE max |
|---|---|
| —o— #60Meyer Bar | 79.62 |
| ---□--- #60+#10Meyer Bar | 81.97 |
| (Heat Treated Receptor) | |
| ---△--- #60Meyer Bar | 72.91 |
| ---▽--- #60+#10Meyer Bar | 78.66 |

Receptor : PVC Film in 770-28 Prous Film

IMAGE-RECEIVING ELEMENT FOR PRODUCTION OF DYE DIFFUSION TYPE THERMAL TRANSFER IMAGE

DETAILED DESCRIPTION OF THE INVENTION

Field of Use

This invention relates to an image-receiving element for the production of a dye diffusion type thermal transfer image. The dye diffusion type thermal transfer technique is one of several techniques capable of producing a color hard copy closely approximating a color image of the silver salt type, and due to the compactness of the system, has recently attracted attention.

As at present it is under development, the system and the material pertaining to this technique apparently have reached a point at which the parties engaging in the use thereof are satisfied, but the desirability of a further technical innovation for decreasing the thermal energy required for printing and stabilizing the printed image has found growing recognition. Particularly, in the system for forming an image by a thermal diffusion of a dye, the role to be fulfilled by the image-receiving layer/image-receiving element is important.

Background of the Art

The conventional method, as disclosed in Japanese Unexamined Patent Publication No. 51,181/1988, forms a uniform dye-receiving layer with a macromolecular material possessing a relatively high glass transition point (Tg=40° C.) and uses this layer as an image-receiving layer. This image-receiving layer has a dubious stability when resisting ultraviolet light because most of the thermally diffused dye gathers along the surface of the image-receiving layer during the formation of an image. When a dye possessing a still lower melting point is used in the donor layer, the image-receiving layer exposes the formed image to the possibility of losing stability, including the thermal stability.

When the image-receiving layer is incorporated therein, a reticulated texture by a cross-linking reaction as disclosed in Japanese Unexamined Patent Publications No. 212,994/1983 and No. 215,398/1983, for example, the incorporated reticular texture naturally induces the image-receiving layer itself to heighten its glass transition point (Tg) and the produced image-receiving layer suffers from the same drawback as the aforementioned homogeneous image-receiving layer notwithstanding the incorporated reticular texture precludes the sticking with the donor surface during the formation of an image.

Japanese Unexamined Patent Publication No. 164,893/1986 discloses a method which comprises using a low boiling solvent for application to an image-receiving layer during the production of the image-receiving layer on a substrate and causing this image-receiving layer, during the step of drying of the applied layer of the solvent, to acquire a finely divided texture. The image-receiving layer obtained by this method has the same effect as the aforementioned homogeneous image-receiving layer.

Japanese Unexamined Patent Publications No. 127,392/1986 and No. 264,896/1989 teach a method of causing an image-receiving layer to acquire a duplex structure consisting of a dye-absorbing layer and a stabilizing layer. This method complicates the structure of the image-receiving layer itself, and in respect of the stability of an image, necessitates a migration of dye from the dye-absorbing layer in the surface to the stabilizing layer by a process other than the printing, particularly by a thermal diffusion.

Japanese Unexamined Patent Publication No. 171,687/1984 discloses a method which comprises introducing metallic ions into an image-receiving layer thereby causing formation of a chelate with a dye, increasing the molecular weight of the dye in the layer, and enabling the dye to be stabilized to resist heat and ultraviolet light even within the high molecular weight image-receiving layer having a low glass transition point. This method has the disadvantage that the chelate varies the tone of the dye and renders difficult an exact reproduction of color. The performance described above cannot be realized by an ordinary combination of a dye with a metallic ion.

BRIEF DESCRIPTION OF THE INVENTION

This invention provides an image-receiving element for the production of a dye diffusion type transfer image, which image-receiving element reduces the drawbacks suffered by the prior art as described above, allows the thermally transferred dye to be stably retained and prevented from lateral diffusion, and therefore, allows a production of a clear image which remains intact for a long time.

This invention attains the purpose mentioned above by an image-receiving element comprising:

(1) a substrate;

(2) an open cell type porous film laminated on the surface of the substrate and formed of a material exhibiting a very low affinity for a dye; and (3) a polymer exhibiting a high affinity for dye, possessing a glass transition point (Tg) of not lower than −5° C. and not higher than 40° C., and filling the pores of the porous film.

DETAILED DESCRIPTION OF THE INVENTION

In contrast to the image-receiving element of the prior art which contains a dye-receiving polymer material in a image-receiving layer, the image-receiving element of this invention has on a substrate an image-receiving layer formed of an olefin-based open cell type porous film exhibiting an extremely low affinity to a dye, such as, for example, polypropylene film or polyethylene film, containing a dye-receiving polymer material in the pores thereof. Generally, an olefin type material has been known as a material devoid of any active sites for attachment of a dye. This material, therefore, is extremely difficult to dye.

The use of such a kind of porous film in an image-receiving layer enables a polymer material possessing a still lower Tg (5° C., for example) to be used as a material for the reception of a dye. This is because the dye-receiving polymer material is present within the pores in a spongeous matrix of a polymer exhibiting an extremely low affinity to a dye and the lattice of pores in the porous film prevents the dye, thermally diffused from the donor layer into the dye-receiving polymeric material, from being diffused in the horizontal direction by the heat used during the formation of an image. In the image-receiving element of the prior art using as the dye-receiving element a polymer material of low Tg, the dye forming an image is easily diffused in the horizontal direction and the image is consequently devoid of thermal stability. In contrast thereto, the image-receiving element of this invention produces an image of a dye which is thermally stable.

Further, the image-receiving element of this invention enhances the fastness of the image of dye to resist ultraviolet light. Particularly when a polymer material possessing a low Tg or containing a plasticizer is used as the dye-receiving material, the image-receiving element enjoys an improved quality and retains high thermal stability. This is because the dye-receiving element possesses a low Tg, and therefore, the dye forming the image within the image-receiving layer does not remain in the surface region of the layer but reaches the depth thereof.

As the dye donor film to be applied to an image-receiving element of the present invention, any conventional dye donor films can be employed. Thus, the dye donor film does not characterize this invention.

A substrate forming an image-receiving element of the present invention can be selected from among any conventional products. The materials which are usable advantageously for this film include, for example, polyethylene terephthalate, polycarbonate, nylon, and paper. The thickness of the substrate is in the range of from 100 μm to 20 μm, preferably from 100 μm to 50 μm.

The material for the porous film of this invention is required to exhibit extremely low affinity to dye and desired to possess no active sites for deposition of the dye. The materials known to satisfy this requirement are polyolefins such as, for example, polypropylene and polyethylene. The film of these material is required to be an open cell type porous film for the purpose of accommodating in the pores a polymer having high affinity to the dye, which will be described more specifically herein below. When the degree of the porosity is to be expressed by the Gurlex value (the time, sec., required for 50 cc of air to pass through a given film), the Gurlex value of the porous film is in the range of from 100 to 5, preferably from 35 to 10. The thickness of the porous film is in the range of from 30 μm to 10 μm, preferably from 25 μm to 15 μm.

The polymer which fills the pores of the porous film possesses affinity to the dye and has the ability to receive the dye. The glass transition point (Tg) of the polymer is in the range of from −5° C. to 40° C., preferably from 5° C. to 20° C. If the glass transition point is unduly high, the image has an extremely low fastness to ultraviolet light. If the glass transition point is unduly low, the dye is thermally diffused even at room temperature within the image-receiving layer to degrade the quality of the image and disrupt the image. The polymers which are effectively usable herein include polyvinyl chloride (PVC), copolymers of vinyl chloride with vinyl acetate, thermo-plastic saturated polyesters, and the like.

The dye-receiving polymer of the image-receiving element of the present invention may incorporate additionally therein a plasticizer such as, for example, di-n-butylphthalate or di-2-ethylhexyl phthalate in a proportion in the range of from 5 to 40% by weight, preferably from 15 to 35% by weight, based on the total weight of the dye-receiving element. If the proportion of the plasticizer is less than 5%, the added plasticizer cannot be expected to impart to the polymer desired fastness to resist the ultraviolet light. If this proportion exceeds 40%, the image has a poor thermal stability and is apt to be diffused. Commercial products of FC-430, FC-431, and FC-124, and the like, are available as a release agent.

The production of the image-receiving element of this invention is accomplished simply by first laminating the porous film on the substrate, then filling the pores in the porous film with a solution of the dye-receiving polymer, and drying the resultant composite. In this case, the dye-receiving polymer plays an additional role as an adhesive agent for fixing the porous film on the substrate. Lamination of the porous film on the substrate can be attained, as generally practiced, simply by superposing the porous film on the substrate and optionally heating the product of superposition to an extent enough to ensure a fast union but not enough to disfigure the pores, for example.

The dye-receiving polymer is first dissolved in a suitable solvent such as, for example, an ordinary organic solvent like tetrahydrofuran or methylethyl ketone in a suitable concentration in the range of from 1 to 30%, preferably from 5 to 10%, to prepare a solution. Then, the solution is applied to the porous film. The applied layer of the solution is dried by heating at a temperature in the range of from 40° C. to 80° C., preferably from 50° C. to 70° C., for a period in the range of from 5 to 60 minutes, preferably from 10 to 30 minutes. When a plasticizer is used, it may be dissolved simultaneously in the solution.

EXAMPLES

Now, this invention will be described more specifically below with reference to working examples. Porous films of polyethylene or polypropylene indicated in Table 1 were used.

TABLE 1

| Material | | TM (°C.) | Thickness (μm) | Gurlex value (sec/50 cc Air) |
|---|---|---|---|---|
| Polyethylene | #06101-5 | 124–131 | 14 | 19 |
| Polypropylene | #770-28 | 163–167 | 20 | 10 |
| Polypropylene | #77O-2S | 159–163 | 25 | 400 |
| Polypropylene | #77O-3S | 158–163 | 17 | 240 |
| Polypropylene | #77O-4S | 158–162 | 15 | 400 |
| Polypropylene | #77O-6S* | 155–160 | 10 | — |
| Polypropylene | #739-2B | 158–162 | 20 | 34 |

*Single face porous film

The following dye-receiving polymers were used.

(1) polyvinyl chloride (PVC)

(2) Copolymer of vinyl chloride with vinyl acetate: Zeon 400×150 J (Nippon Zeon)

(3) Polyesters: Vylon 290, Vylon 200, Vylon 300, Vylon GK 570, and Vylon GK 550 (Toyo Spinning Co., Ltd.) Vitel PE 307 (Goodyear)

(4) PVC film (Mitsubishi Kasei Vinyl K.K.)

A polymer solution was prepared by dissolving such a polymer in a concentration of 5% in tetrahydrofuran. Where a plasticizer was used, di-n-butyl phthalate as a plasticizer was dissolved in conjunction with the polymer in the solution. Where a release agent was used" FC-430 (produced by 3M Corp.) was dissolved in a concentration of 5% in THF.

The production of an image-receiving element was effected by fixing a varying porous film indicated in Table 1 on a polyethylene terephthalate (PET) film 4 mil in thickness with an adhesive tape (produced by 3M Corp. and marketed under trademark designation of "Scoth Tape #811-1-18"), applying the polymer solution prepared as described above to the upper surface of the porous film by the use of a Mayer bar, and drying the applied layer of the solution at 65° C. for 20 hours. The image-receiving element thus obtained will be designated as "Type 1" hereinafter.

Subsequently, the image-receiving element produced as described above was heat-treated with a heat roller (produced by Gumma UUshio and marketed under product code of "190C") illustrated in FIG. 1 or a thermal printer (produced by 3M Corp. and marketed under the trademark of "Test Printer 7 Volts"). The image-receiving element thus obtained will be designated as "Type 2" hereinafter. As illustrated in FIG. 1, a polytetrafluoroethylene film (PTFE) 10 4 mil in thickness was superposed on the image-receiving layer side of the image-receiving element 12 comprising the substrate 14 and the image-receiving layer 16, and the resultant laminate was nipped between a PET film 18 2 mil in thickness and a PET film 20 4 mil in thickness and pressed with heat rollers 28. In FIG. 2, a polyethylene terephthalate film 24 (PET) 3.5 μm in thickness was superposed on the image-receiving layer side of the image-receiving element 12 comprising the substrate 14 and the image-receiving layer 16, and heating the produced laminate from the PET film 25 side by the use of a thermal head.

Separately, an image-receiving element was obtained by applying the aforementioned polymer solution to a PET film (substrate) 4 mil in thickness by the use of a Mayer bar and then drying the applied layer of the solution at 65° C. for 20 minutes. This image-receiving element will be designated as "Type 3" hereinafter.

The image-receiving elements obtained as described above were evaluated as follows.

Print

As a donor film, the product of Minnesota Mining and Manufacturing Company (3M) was used. This donor film 22 was superposed on a given image-receiving element 12 as illustrated in FIG. 3 and an image was formed by the use of a thermal printer (produced by Minnesota Mining and Manufacturing Company) provided with a thermal head 26 rated for 100 dpi in a width of 3 cm, with a load of 1.9 kg applied to the head. The applied voltage was set at 7 volts and the burn time at 6.4 m.sec. The thermal energy consequently generated was 2.08 J/cm$^2$.

Evaluation of Thermal Stability

A sample print was left to age at 50° C. for 65 hours. The sample was examined with an optical microscope before and after the aging.

Evaluation of Stability to Resist Ultraviolet Light

A sample was left to stand under the light from Q-UV (351 nm lamp) at 50° C. The data on the time-course change of the fading of the sample consequently obtained was analyzed for evaluation by the use of a chronometer produced by Minolta K.K. and marketed under product code "Model CR-A11") provided with a data processor (produced by Minolta K.K. and marketed under product code "Model DP-100").

The amount of the change mentioned above was expressed in Delta E/Delta Emax.

Delta E=[L*t−L*o)2+(a*t−a*o)2+(b*t−-b*o)211/2

Delta EMax=[(L*o−L*B)2+(a*o−a*B)2+(-b*o—b*B)2]1/2

L*t, a*t, and b*t: L*, a*, and b* of a given sample print after the elapse of time, t, under the light of Q-UV.

L*o, a*o, and b*o: L*, a*, and b* of a given sample print before the evaluation as to stability to resist ultraviolet light.

L*B, a*B, and b*B: L*, a*, and b* of a given sample print before the evaluation of the image-receiving element itself containing the image-receiving layer.

L* stands for lightness, a* for chromaticity from red (+a*) to green (−a*), and b* for chromaticity from yellow (+b*) to blue (−b*).

The meaning of the expression, Delta E/Delta Emax, is such that the stability of a sample to resist a change of color increases in proportion as the magnitude of this expression approximates 0.

EXAMPLE 1

As image-receiving film of Type 1 was produced by using Vylon 300 as an image-receiving element and applying a solution of Vylon 300 by the use of a Mayer bar #40 to the upper surface of a porous film, 770-28, fixed on a PET film 4 mil in thickness. A printed image was produced with a magenta donor film and the image-receiving film by the method illustrated in FIG. 3 and tested for thermal stability by 65 hours' standing (aging) at 50° C. The results are shown in FIG. 4 (before aging) and FIG. 5 (after aging). The image showed no sign of distortion by heating despite such a low Tg as 7° C.

COMPARATIVE EXAMPLE 1

As image-receiving film of Type 3 was produced by directly applying a solution of Vylon 300 to the upper surface of a PET film 4 mil in thickness by the use of a Mayer bar #10. A printed image produced in the same manner as in the preceding example was evaluated as to thermal stability under the same conditions as described above. The results are shown in FIG. 6 (before aging) and FIG. 7 (after aging). The homogeneous-phase type image-receiving layer, owing to a low Tg, showed a sign of disturbance of the printed image, namely, the diffusion of dye by heat. Thus, the layer had an extremely poor resolution.

EXAMPLE 2

Vylon GK 570 was used as a dye-receiving element. An image-receiving film of Type 1 was produced by the same method as used in Example 1. A magenta printed image was produced and tested for thermal stability under the same conditions as used in Example 1. The results are shown in FIG. 8 (before aging) and FIG. 9 (after aging). The printed image was stable even though Vylon GK 570 had a lower Tg (5° C.) than Vylon 300.

COMPARATIVE EXAMPLE 2

An image-receiving film of Type 3 was produced by following the procedure of Comparative Example 1, excepting Vylon GK 570 was used as a dye-receiving element.

A magenta printed image was formed on the film and tested for thermal stability under the same conditions as described above. The results are shown in FIG. 10 (before aging) and FIG. 11 (after aging). Since the image-receiving layer was formed of a homogeneous phase of low Tg, the diffusion of dye by heating in the longitudinal direction could not be restrained. The printed image was consequently blurred. This indicates a lack of resolution.

COMPARATIVE EXAMPLE 3

An image-receiving film was produced by following the procedure of Example 1, except that Vylon GK 550 was used as a dye-receiving element. A magenta printed image was produced on the film and tested for thermal stability under the same conditions as described above. The results are shown in FIG. 12 (before aging) and FIG. 13 (after aging). Since Vylon GK 550 had such a low Tg as −9° C., the effect of the porous film was not manifested.

EXAMPLE 3

Three kinds of polyester having different Tg values [Vylon 290 (Tg=77° C.), Vylon 200 (Tg=67° C.), and Vitel PE 307 (Tg=16° C.)] were used as dye-receiving elements, and were applied to a porous film 770-28 fixed on a PET film 4 mil in thickness by the use of a Mayer bar #40 and then dried, to produce image-receiving films of Type 1. Printed images were produced by the method illustrated in FIG. 3 from these image-receiving films and a magenta donor, and then tested for resistance to ultraviolet light. The results are shown in FIG. 14. With the polyesters of one series, the lightresistance was found to depend on the lowness of Tg. The ability of polyester to stabilize a dye increased in proportion as the Tg value of the polyester decreased. These results were obtained when the porous film 370-28 was used in combination with a polyester resin.

COMPARATIVE EXAMPLE 4

Two polymer materials having relatively high Tg values [PVC (Tg=88° C.) and Zeon 400×150 J (Tg=75° C.)] were used as dye-receiving elements. Image-receiving films of Type 1 were produced from the porous film 770-28 and a Mayer bar #40 and image-receiving films of Type 3 were produced from the PFT film 4 mil in thickness and a Mayer bar #10. Printed images were produced using magenta donor film by the method illustrated in FIG. 3. They were tested for lightresistance. The results are shown in FIG. 15. Since the Tg values were both as high as about 80° C., the image produced with the two types of image-receiving films showed virtually no difference in the results of the test for lightresistance.

EXAMPLE 4

The same PVC as used in Comparative Example 4 incorporated di-n-butyl phthalate for lowering the Tg value. The samples of dye-receiving element of varying Tg values consequently obtained were tested for lightresistance of printed image as a function of the amount of plasticizer. Image-receiving films of Type 1 were produced by the use of a Mayer bar #40. Printed images were produced using a magenta donor film by the method illustrated in FIG. 3 and tested for lightresistance. The results are shown in FIG. 16. The printed images using PVC alone or PVC incorporating a release agent therein showed the same instability as those of Comparative Example 4. The printed images using the polymer incorporating a plasticizer therein showed an extremely different stability.

The symbols used in FIG. 16 and FIG. 17 were as follows.

(1) PVC+FC: Solution of 6 g of PVC in THF (5% by weight), and solution of 0.13 g of FC 430 in THF (5% by weight)
(2) PVC+Ph 2.63: Combination of 5 g of PVC, 2.63 g of di-n-butyl phthalate and 92.37 g of THF
(3) PVC+Ph 2.36+FC: Solution of 6 g of (PVC+Ph 2.36) and 0.13 g of FC 430 in THF (5% by weight)
(4) PVC+Ph 5: Combination of 5 g of PVC, 5 g of di-n-butyl phthalate and 90 g of THF
(5) PVC+Ph 5+FC: Solution of 6 g of (PVC+Ph 5) and 0.13 g of FC 430 in THF (5% by weight)

COMPARATIVE EXAMPLE 5

The same dye-receiving material as used in Example 4 was applied on a PET film 4 mil in thickness by the use of a Mayer bar #10. An image-receiving film of Type 3 was produced. A magenta printed image was produced by the same method as used in Example 4 and tested for lightresistance. The results are shown in FIG. 17. The addition of di-n-butyl phthalate brought about an effect opposite the intended effect. Thus, the combination of the porous film and the dye-receiving element possessing a low Tg was found to be closely related to not only thermal stability but also lightresistance.

EXAMPLE 5

A PVC film (produced by Mitsubishi Kasei Vinyl K.K.) as a dye-receiving element was dissolved in THF in a concentration of 5% by weight. The resultant solution was applied by the use of three different Mayer bars to three pieces of porous film 770-28 fixed on a PET film 4 mil in thickness, and after drying, the image-receiving layers thereof was subjected to the heat treatments illustrated in FIG. 1 and FIG. 2 in the order mentioned, to produce image-receiving films of Type 2. Printed images were produced by using these image-receiving films in conjunction with a magenta donor film by the method illustrated in FIG. 3 and then tested for lightresistance. The results are shown in FIG. 18. In the absence of the dye-receiving elements, the images of dye showed virtually no stability. In the presence of dye-receiving element, the stability varied with the thickness of coating applied. A substantially constant lightresistance was obtained by the Mayer bar #40.

COMPARATIVE EXAMPLE 6

A magenta printed image was produced by following the procedure of Example 5 using an image-receiving film of Type 3 produced by applying the same dye-receiving element as used in Example 5 to a PET film 4 in thickness with the aid of a Mayer bar #10, an image-receiving film of Type 3 (produced by 3M Corp. and marketed under product code of "GRL"), and a porous film 770-28. This printed image was tested for lightresistance. The results are shown in FIG. 19. such lightresistance as observed in Example 5 was not found.

COMPARATIVE EXAMPLE 7

On a PET film 4 mil in thickness, the same dye-receiving element as used in Example 5 was applied by the use of several different grades of Mayer bars, to produce image-receiving films of Type 3. Magenta printed images were produced by the same method as used in Example 5 and tested for lightresistance. The results are shown in FIG. 20. The results indicate that the lightresistance of image increased in proportion as the thickness of dye-receiving layer increased. The images showed no thermal stability.

EXAMPLE 6

Image-receiving films of Type 1 were produced by applying the same dye-receiving element as used in Example 5 on several kinds of porous film. Magenta printed images were produced by the method illustrated in FIG. 2. In only the three printed images illustrated in FIG. 11, no mass transfer of the dye and the binder from the donor layers was detected. From the data of the test for lightresistance shown in FIG. 21, the porous films 770-28 and 06101-5 showed satisfactory results.

EXAMPLE 7

Image-receiving films of type 1 were produced by applying the same dye-receiving element as used in Example 5 to a porous film 770-28 fixed on a PET film 4 mil in thickness by the use of several species of Mayer bars. Printed images were produced from a yellow donor film on these image-receiving films by the method illustrated in FIG. 3 and then tested for lightresistance. The results are shown in FIG. 22. The lightresistance of yellow printed image was observed to vary with the thickness of coating applied. The lightresistance increased in proportion as the thickness increased.

EXAMPLE 8

Cyan images were produced in the same manner as in Example 7 by using a cyan donor film and the same image-receiving films of Type I as produced in Example 7. These images were tested for lightresistance. The results are shown in FIG. 23. In these cyan images, the lightresistance was found to vary with the thickness of the dye-receiving element applied. Again, the lightresistance increased in proportion as the thickness increased.

EXAMPLE 9

Image-receiving films of Type 2 were produced in the same manner as in Example 5. From yellow, magenta, and cyan donor films, images were formed on the image-receiving layers by the method illustrated in FIG. 2. These images were tested for lightresistance. The results of the test for lightresistance in three independent colors are shown in FIG. 24 and the results in the mixture of the three colors shown in FIG. 25.

EXAMPLE 10

An image-receiving film of Type 1 was produced by applying the same dye-receiving element as used in Example 5 to a porous film 770-28 fixed on a PET film 4 mil in thickness by the use of Mayer bar #60. Another image-receiving film was produced by repeating the procedure described above and additionally applying the same image-receiving element solution on the produced film by the use of a Mayer bar #10. These two image-receiving films were subjected sequentially to the heat treatments illustrated in FIG. 1 and FIG. 2 in the order mentioned, to complete image-receiving films of Type 2. From a magenta donor film, images were formed on the image-receiving films by the method illustrated in FIG. 3. These images were tested for lightresistance. The results are shown in FIG. 26. In the samples involving the use of a Mayer bar #60, the pores in the porous films were found after drying to be filled with the dye-receiving element to a fairly large extent. When the dye-receiving element was further applied thereto by the use of a Mayer bar #10, the porous film ceased to possess its porous texture. The magenta images formed thereon exhibited a very high stability to ultraviolet light.

COMPARATIVE EXAMPLE 8

On a commercially available opaque image-receiving element (Type 3), yellow, magenta, and cyan images were formed from donors of the respective colors by the method illustrated in FIG. 3. These images were tested for lightresistance. The results are shown in FIG. 27. The data indicate that the dyes of these three colors were invariably unstable.

COMPARATIVE EXAMPLE 9

On another commercially available opaque image-receiving element (Type 3), yellow, magenta, and cyan images were formed from donors of the respective colors by the same method as used in Comparative Example 8. These images were tested for lightresistance. The results are shown in FIG. 28.

It is clear from the data that the images of these three colors were invariably unstable.

Figure 1:
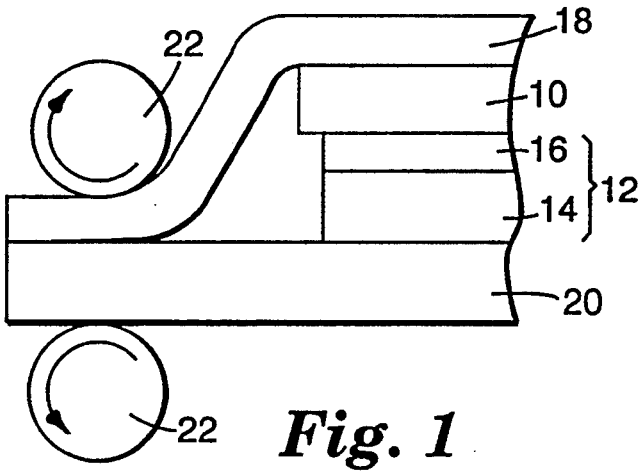
FIG. 1 is a diagram illustrating a method of heat-treating an image-receiving element of this invention.
Figure 2:
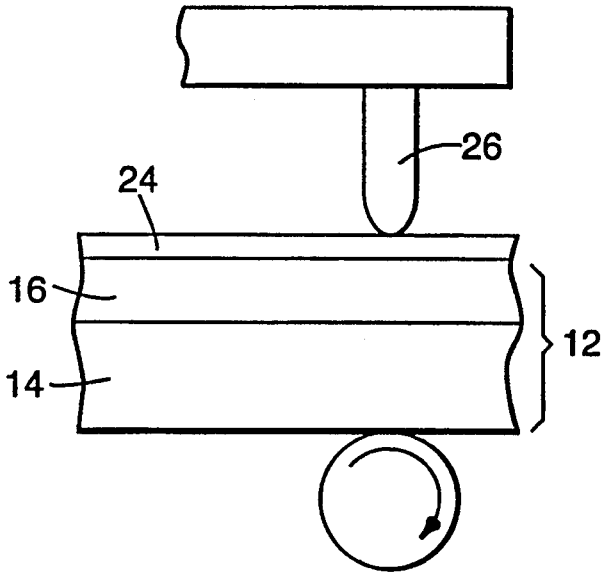
FIG. 2 is a diagram illustrating a method of heat-treating an image-receiving element of this invention.
Figure 3:
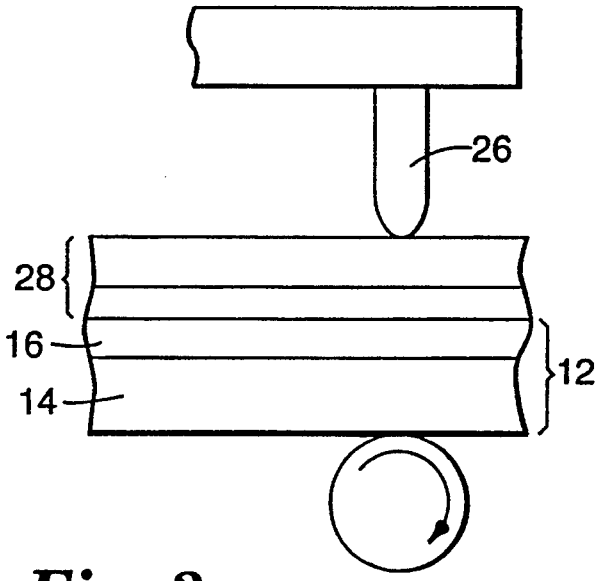
FIG. 3 is a diagram illustrating a method of testing an image-receiving element of this invention as to formation of an image.
Figure 4:
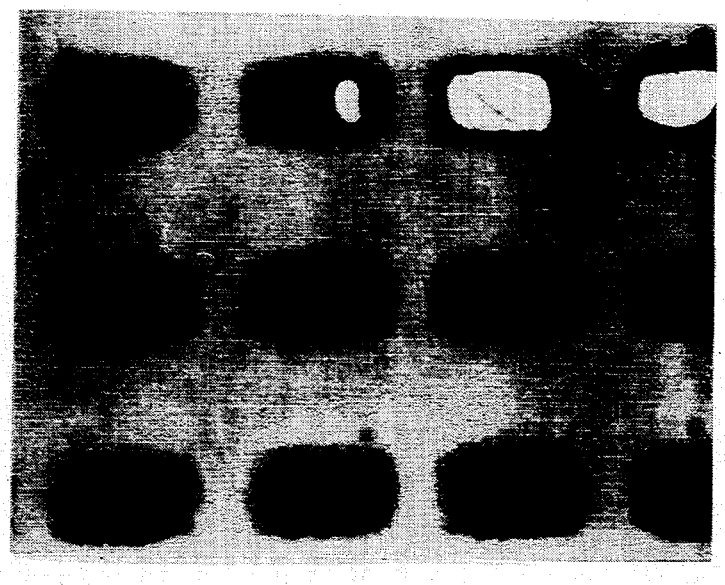
FIG. 4 is a photograph depicting on behalf of a diagram an image (before aging) formed of an image-receiving element prepared in Example 1.
Figure 5:
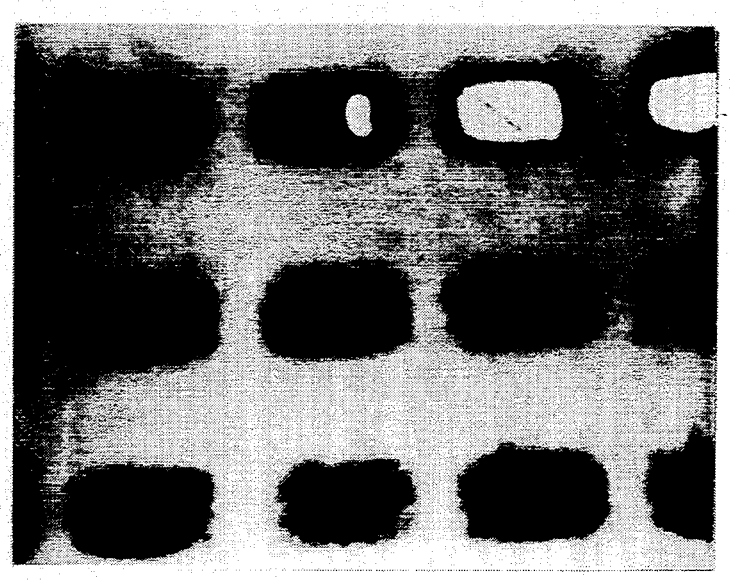
FIG. 5 is a photograph depicting on behalf of a diagram an image (after aging) formed of an image-receiving element prepared in Example 1.
Figure 6:
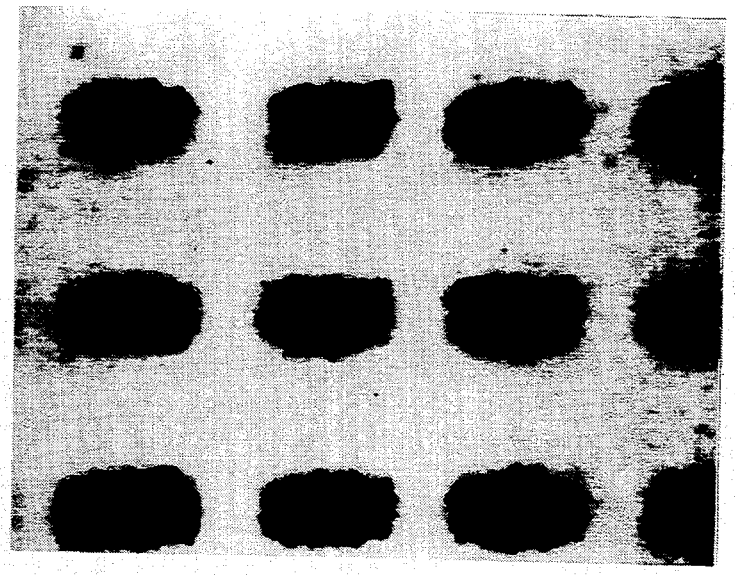
FIG. 6 is a photograph depicting on behalf of a diagram an image (before aging) formed of an image-receiving element prepared in Comparative Example 1.
Figure 7:
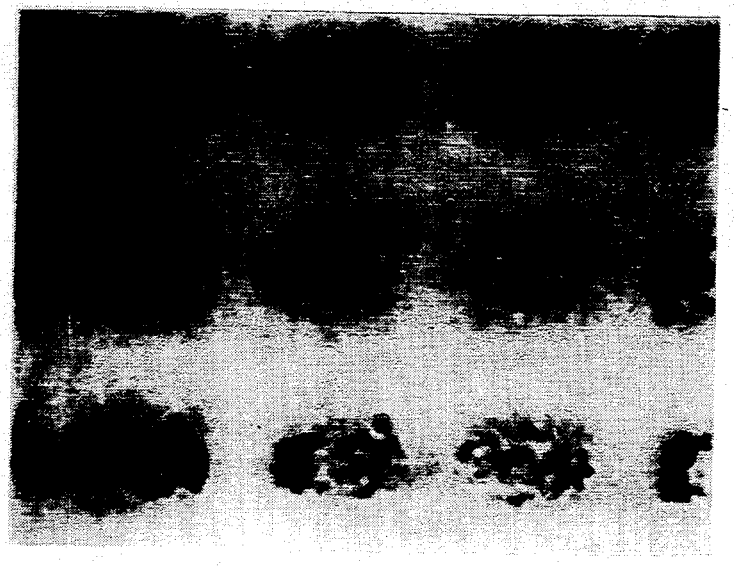
FIG. 7 is a photograph depicting on behalf of a diagram an image (after aging) formed of an image-receiving element prepared in Comparative Example 1.
Figure 8:
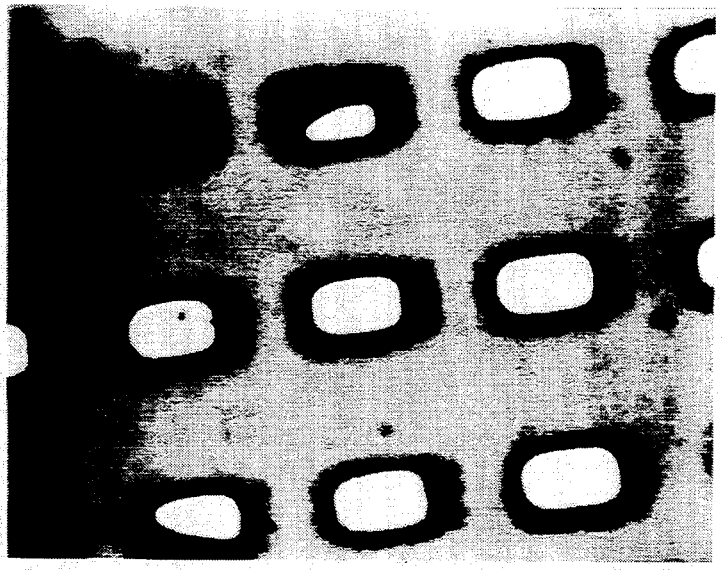
FIG. 8 is a photograph depicting on behalf of a diagram an image (before aging) formed of an image-receiving element prepared in Example 2.
Figure 9:
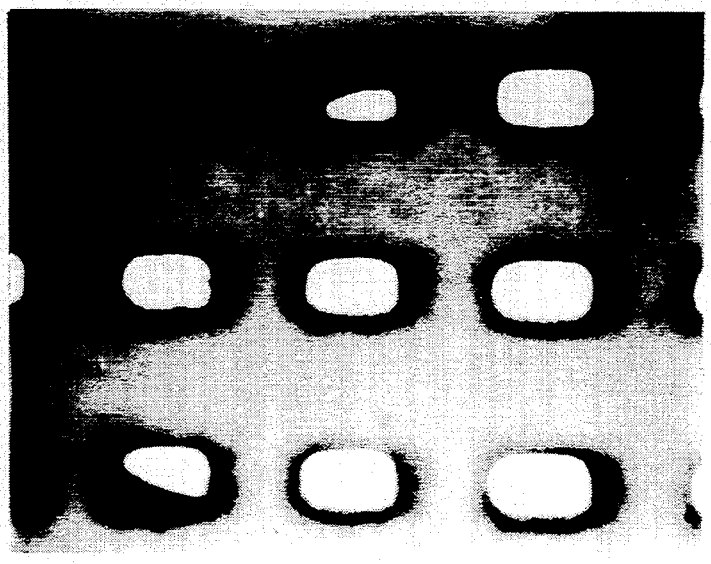
FIG. 9 is a photograph depicting on behalf of a diagram an image (after aging) formed of an image-receiving element prepared in Example 2.
Figure 10:
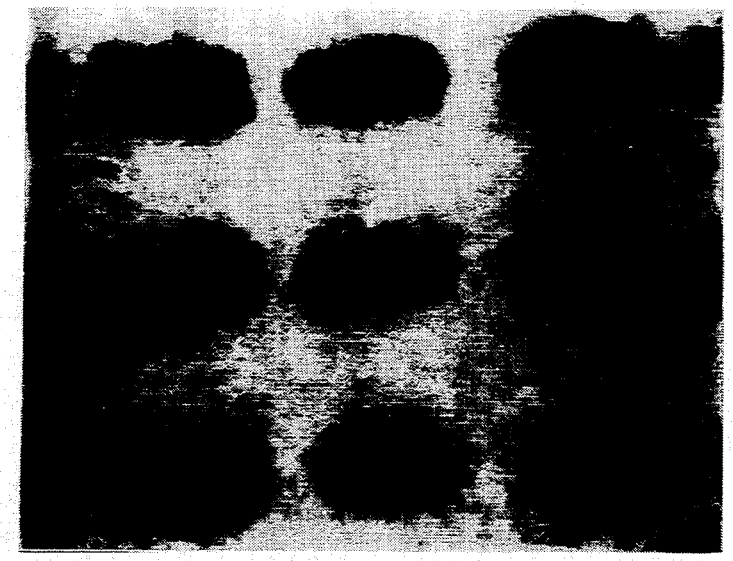
FIG. 10 is a photograph depicting on behalf of a diagram an image (before aging) formed of an image-receiving element prepared in Comparative Example 2.
Figure 11:
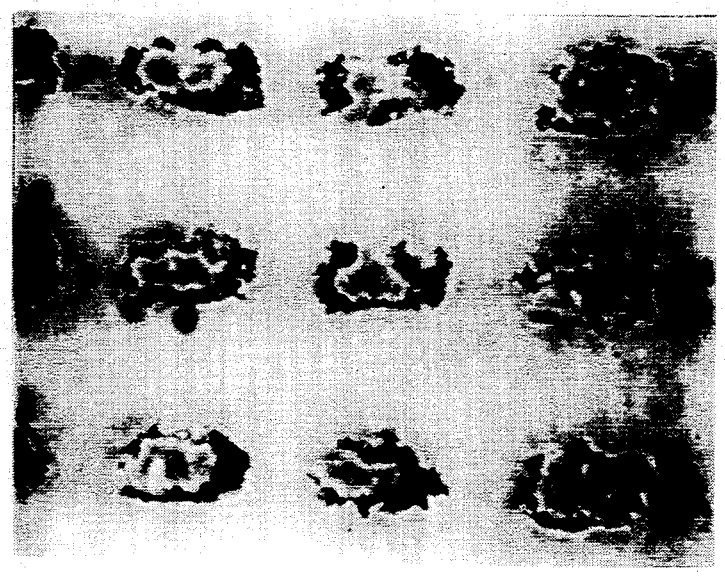
FIG. 11 is a photograph depicting on behalf of a diagram an image (after aging) formed of an image-receiving element prepared in Comparative Example 2.
Figure 12:
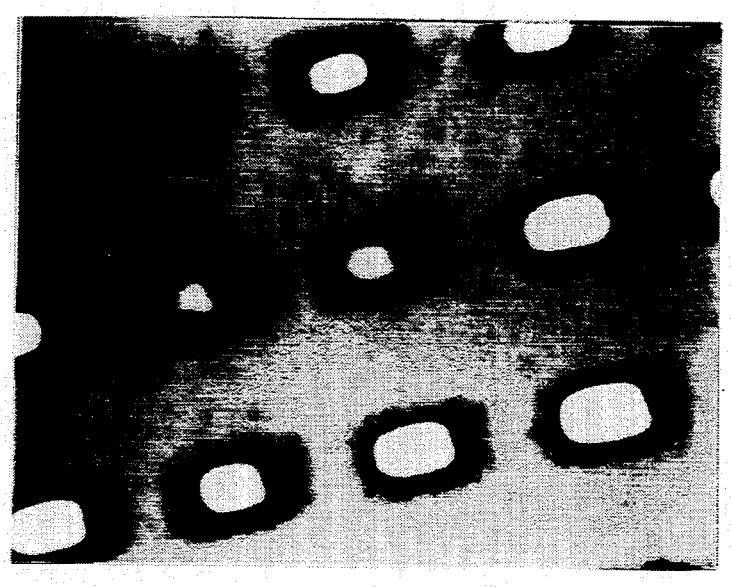
FIG. 12 is a photograph depicting on behalf of a diagram an image (before aging) formed of an image-receiving element prepared in Comparative Example 3.
Figure 13:
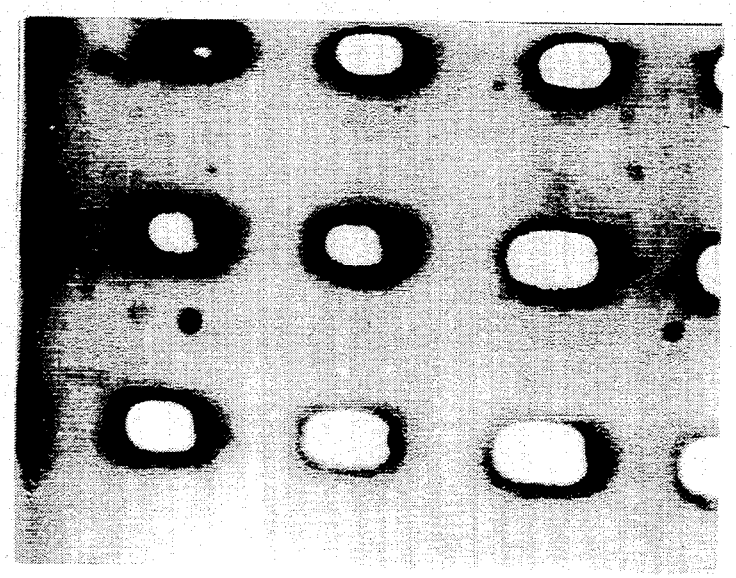
FIG. 13 is a photograph depicting on behalf of a diagram an image (after aging) formed of an image-receiving element prepared in comparative Example 3.
Figure 14:
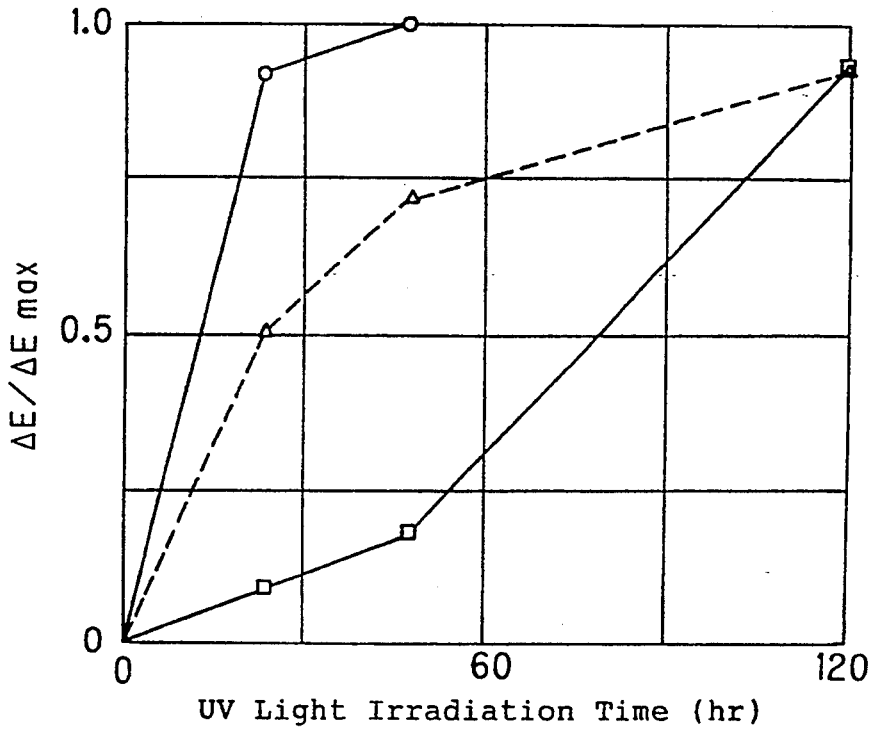
FIG. 14 is a graph showing the results of a test for lightresistance performed on an image formed of an image-receiving element prepared in Example 3.
Figure 15:
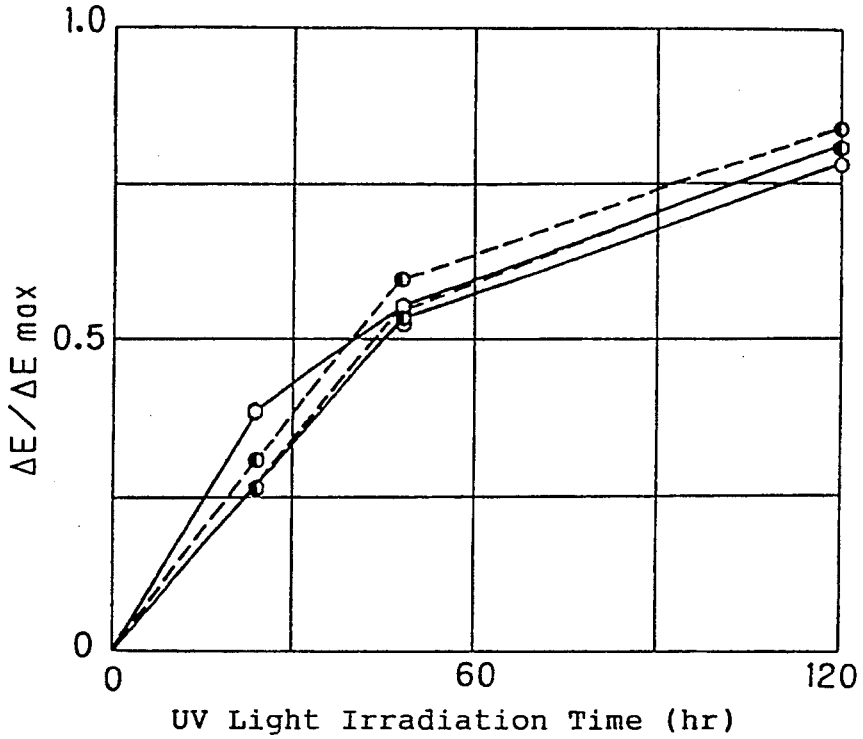
FIG. 15 is a graph showing the results of a test for lightresistance performed on an image formed of an image-receiving element prepared in Reference Example 4.
Figure 16:
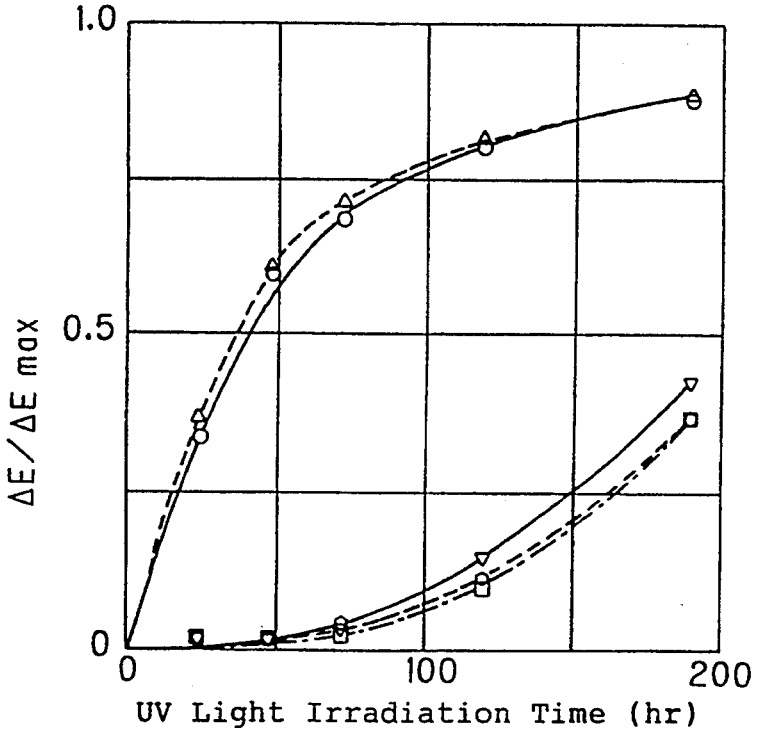
FIG. 16 is a graph showing the results of a test for lightresistance performed on an image formed of an image-receiving element prepared in Example 4.
Figure 17:
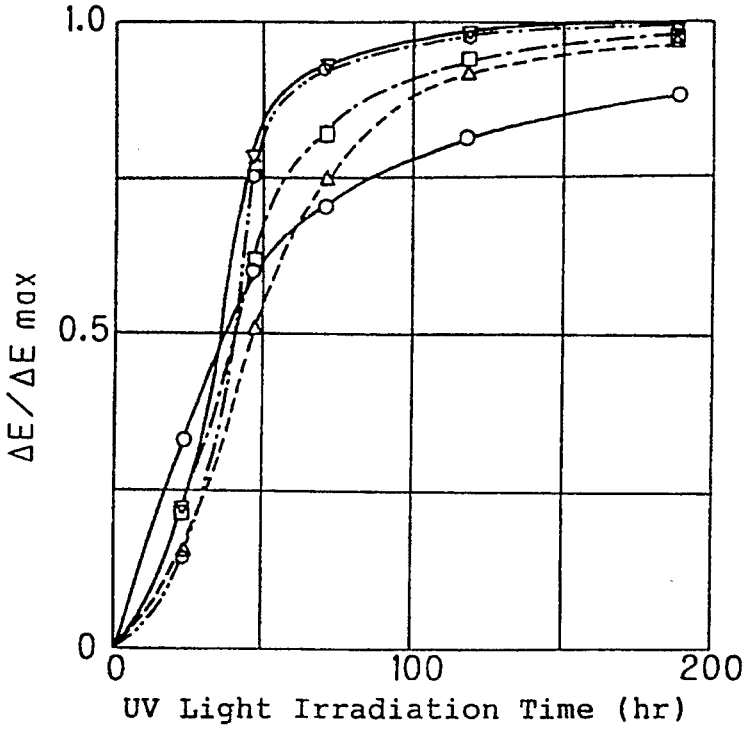
FIG. 17 is a graph showing the results of a test for lightresistance performed on an image formed of an image-receiving element prepared in Example 5.
Figure 18:
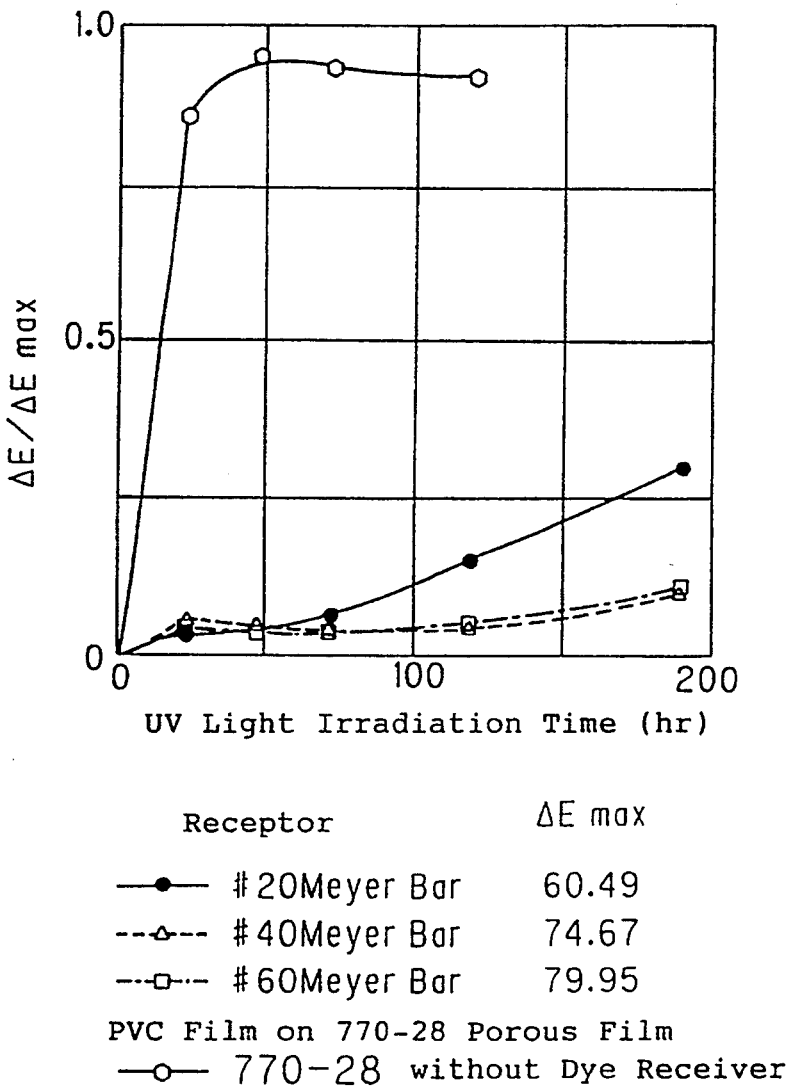
FIG. 18 is a graph showing the results of a test for lightresistance performed on an image formed of an image-receiving element prepared in Reference Example 5.
Figure 19:
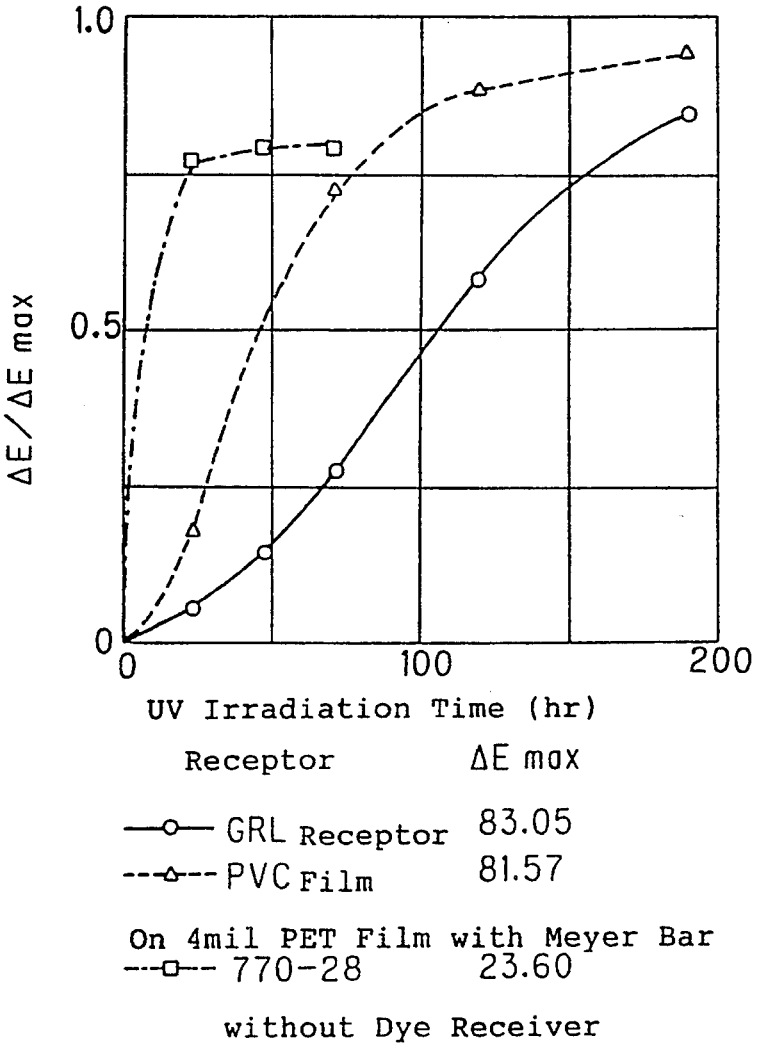
FIG. 19 is a graph showing the results of a test for lightresistance performed on an image formed of an image-receiving element prepared in Comparative Example 6.
Figure 20:
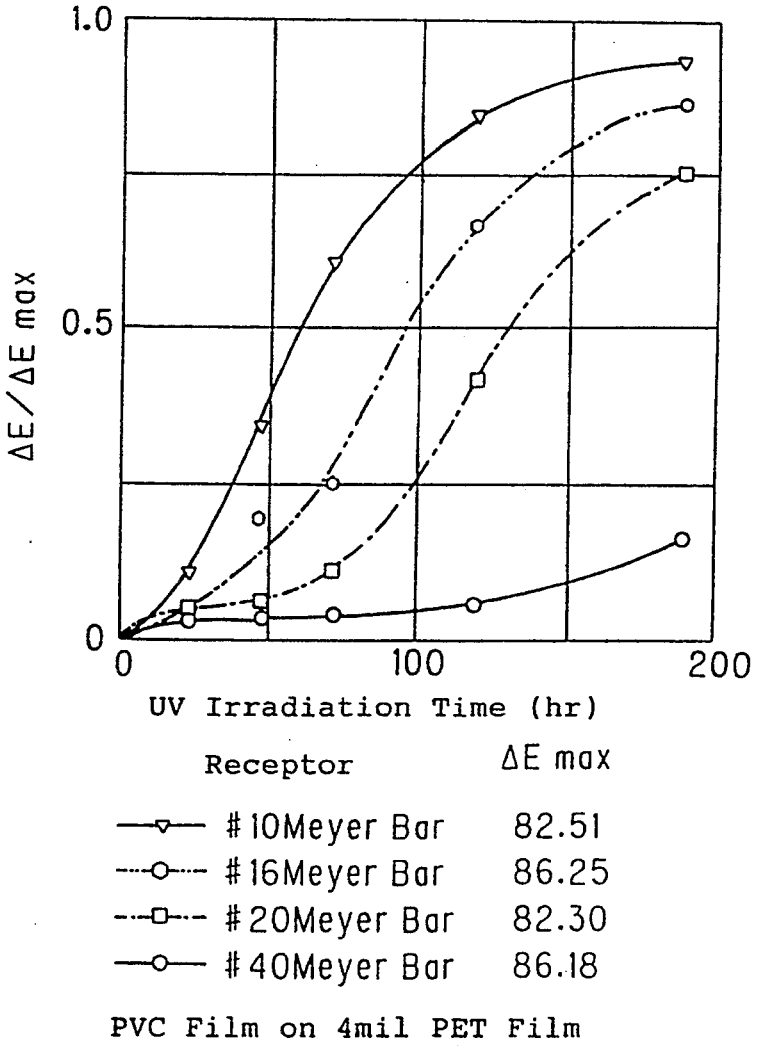
FIG. 20 is a graph showing the results of a test for lightresistance performed on an image formed of an image-receiving element prepared in Comparative Example 7.
Figure 21:
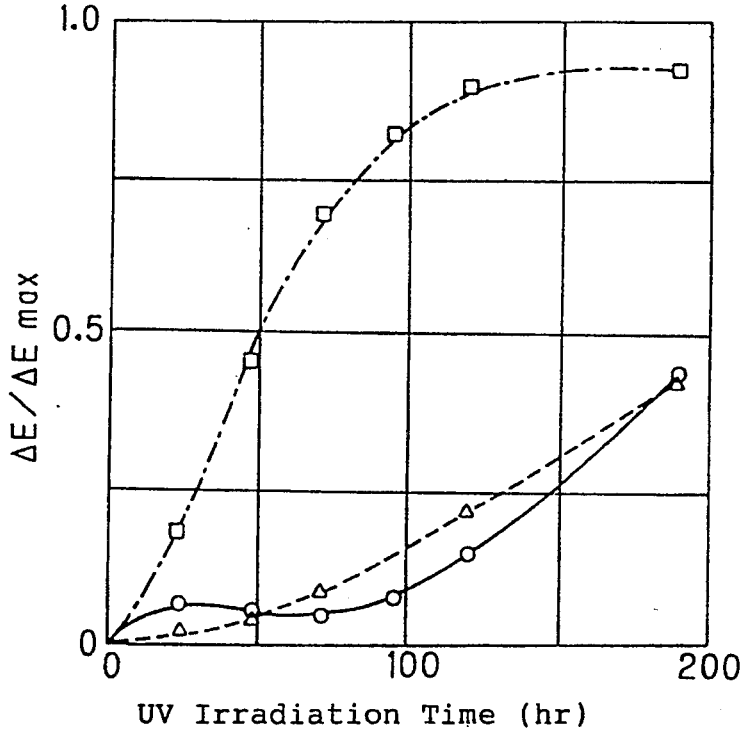
FIG. 21 is a graph showing the results of a test for lightresistance performed on an image formed of an image-receiving element prepared in Example 6.
Figure 22:
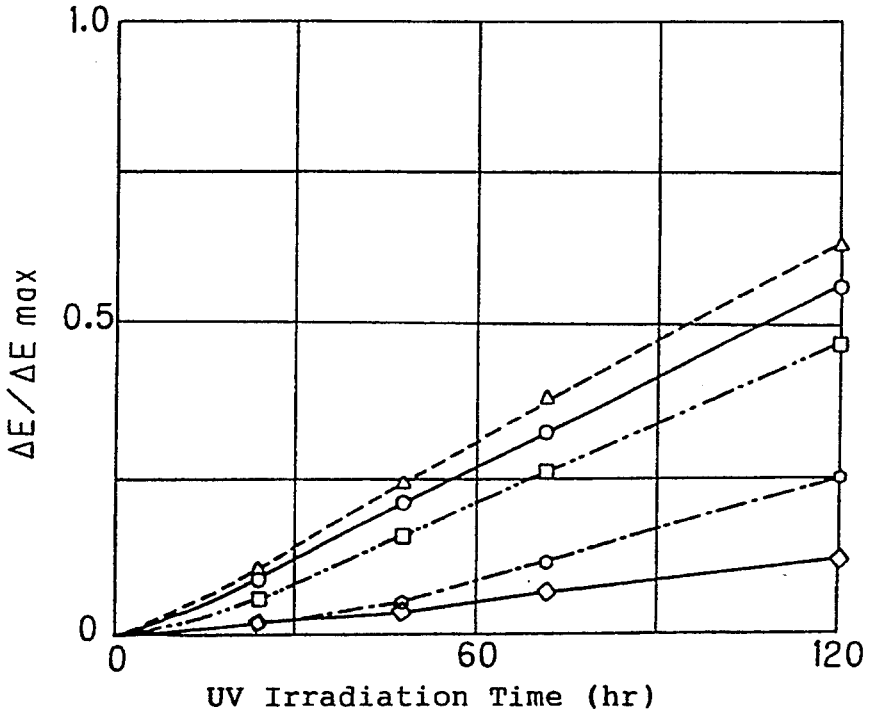
FIG. 22 is a graph showing the results of a test for lightresistance performed on an image formed of an image-receiving element prepared in Example 7.
Figure 23:
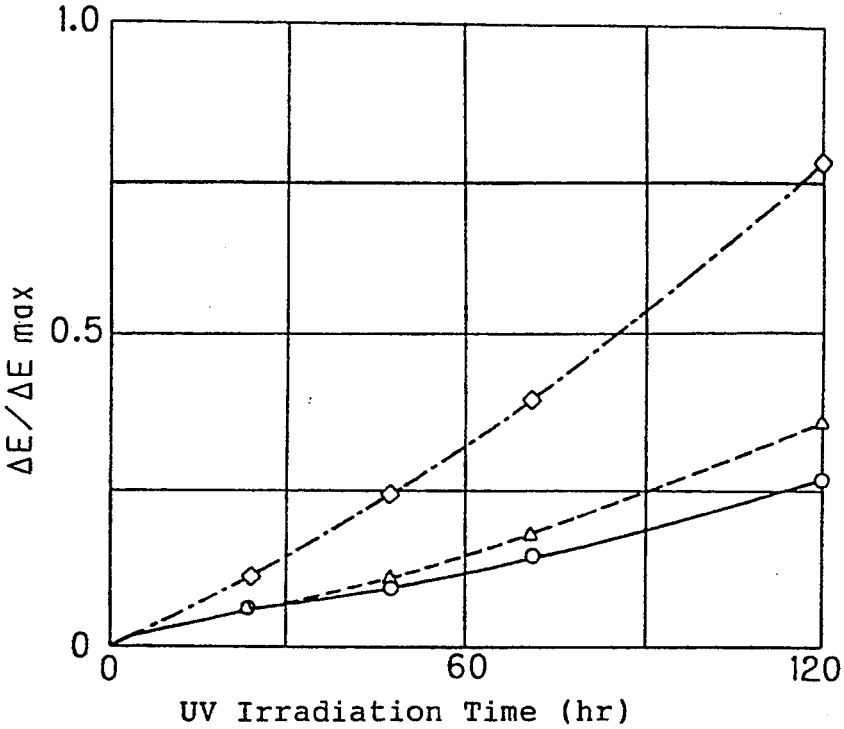
FIG. 23 is a graph showing the results of a test for lightresistance performed on an image formed of an image-receiving element prepared in Example 8.
Figure 24:
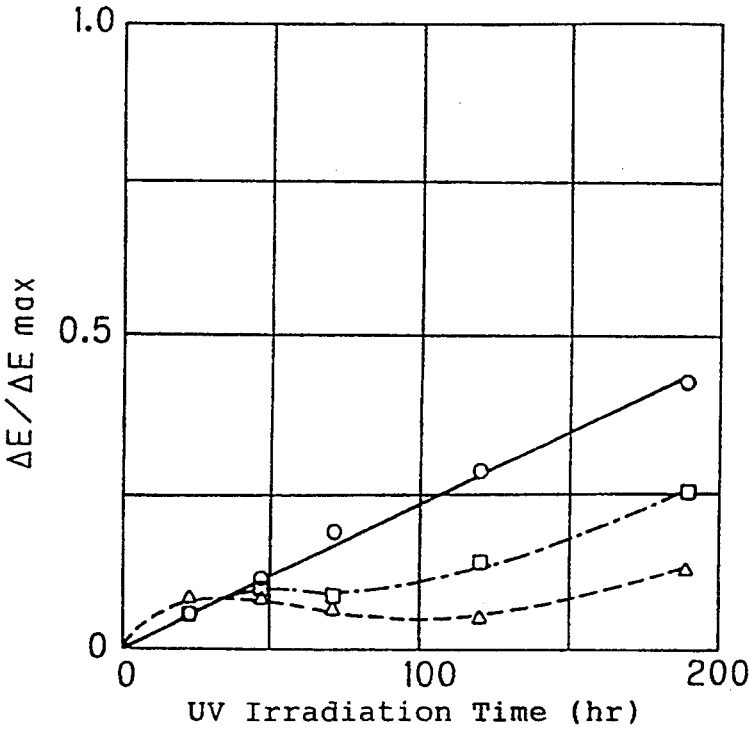
FIG. 24 is a graph showing the results of a test for lightresistance performed on an image formed of an image-receiving element prepared in Example 9.
Figure 25:
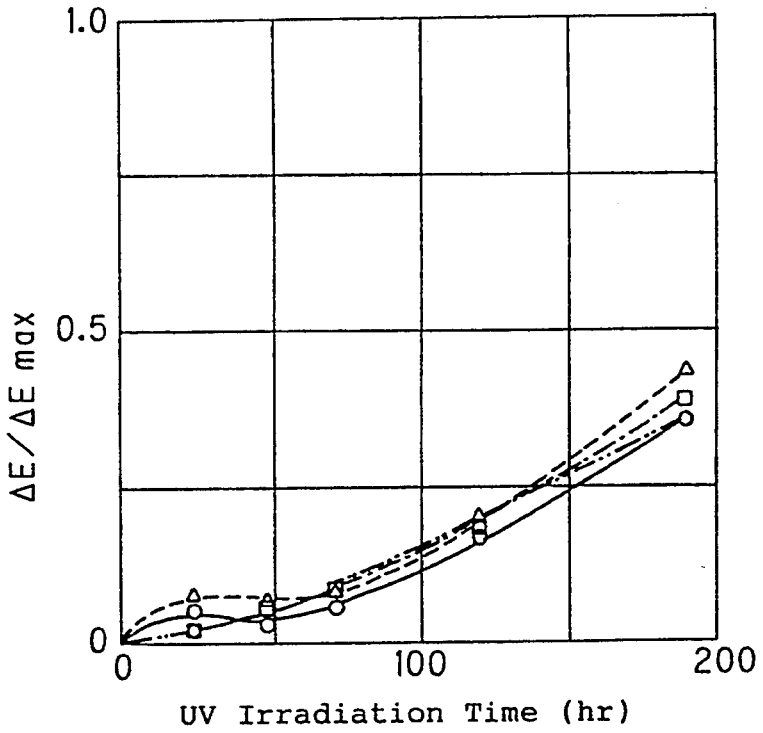
FIG. 25 is a graph showing the results of a test for lightresistance performed on an image formed of an image-receiving element prepared in Example 9.
Figure 26:
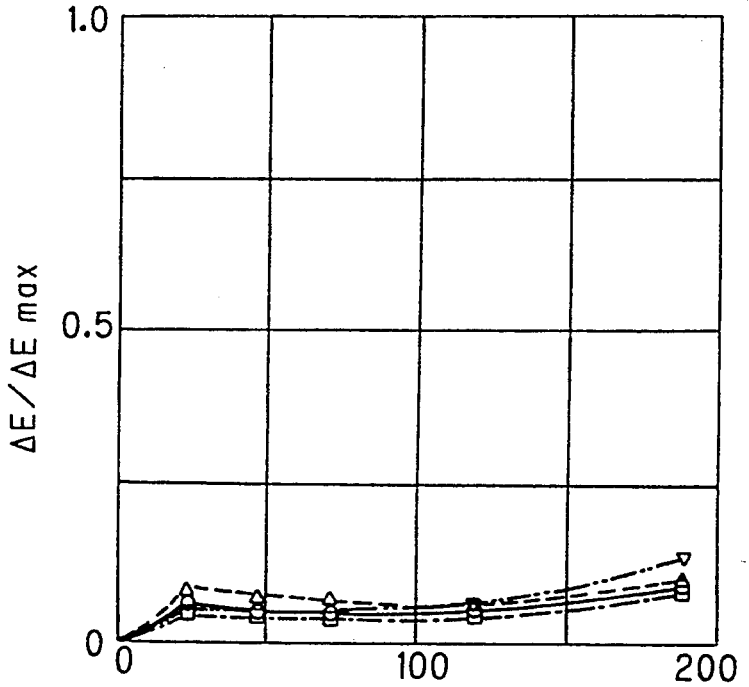
FIG. 26 is a graph showing the results of a test for lightresistance performed on an image formed of an image-receiving element prepared in Comparative Example 10.
Figure 27:
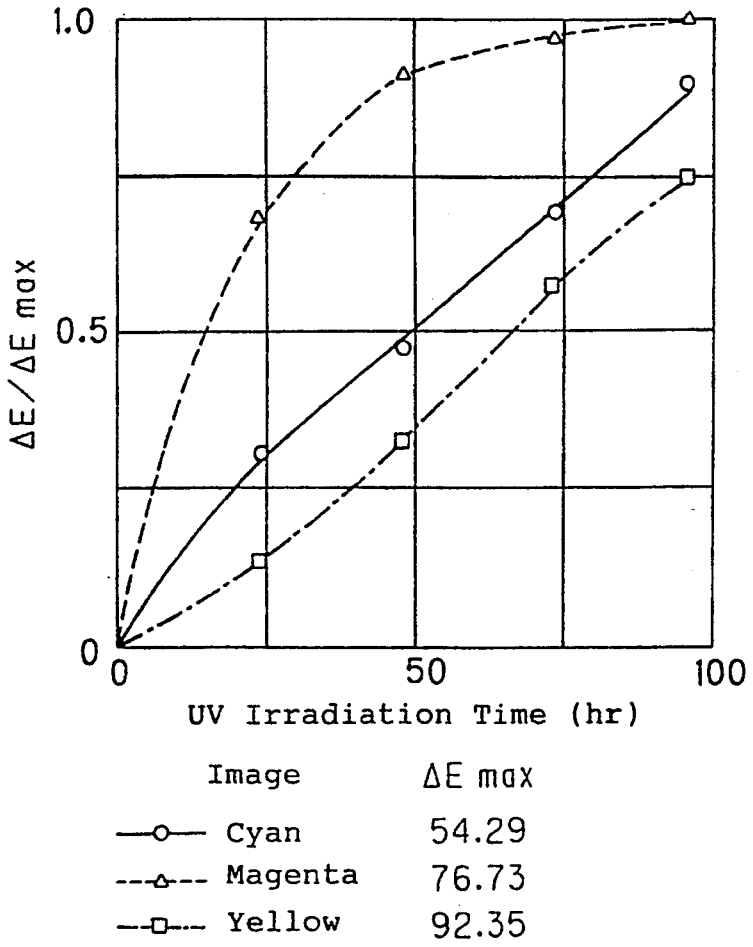
FIG. 27 is a graph showing the results of a test for lightresistance performed on an image formed of an image-receiving element prepared in Comparative Example 8.
Figure 28:
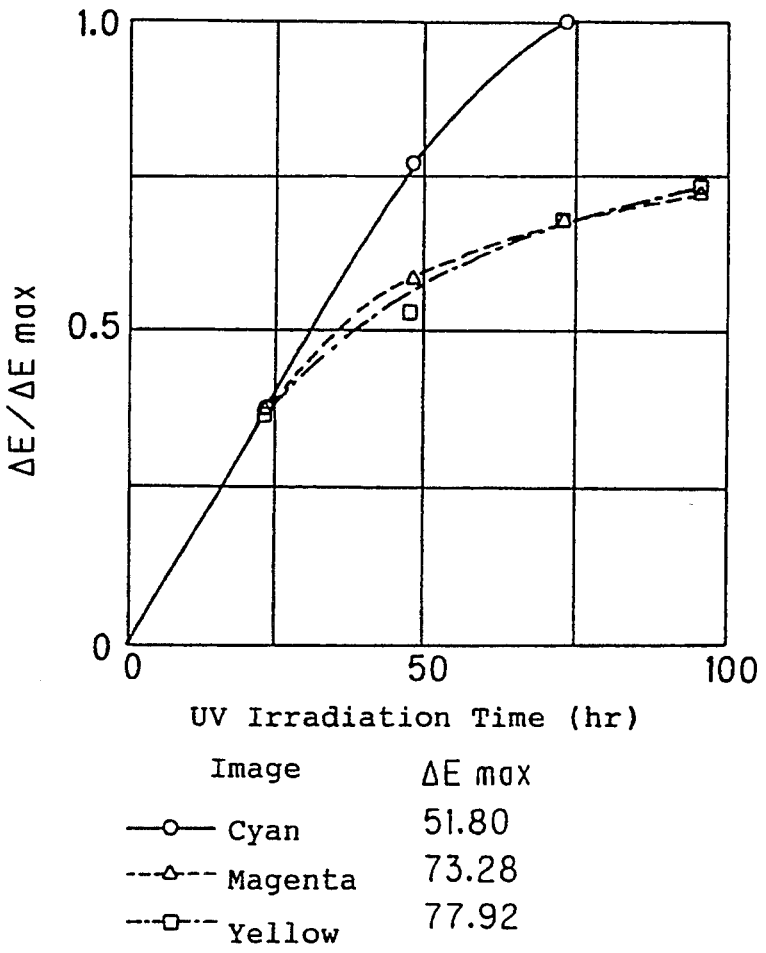
FIG. 28 is a graph showing the results of a test for lightresistance performed on an image formed of an image-receiving element prepared in Comparative Example 9.

I claim:

1. An image-receiving element comprising:

(1) a substrate;

(2) an open cell porous film laminated on the surface of said substrate and formed of a material exhibiting a very low affinity for dye;

(3) a polymer exhibiting a high affinity for dye, possessing a glass transitition temperature point of not lower than −5° C. and not higher than 40° C., and filling the pores of said porous film; and (4) a dye image distributed on said surface of said substrate.

2. An image-receiving element according to claim 1, wherein said material exhibiting a very low affinity for said dye is a polyolefin.

3. An image-receiving element according to claim 2, wherein said polymer exhibiting a high affinity for said dye is polyvinyl chloride, a copolymer of vinyl chloride with vinyl acetate, or a polyester.

4. An image-receiving element according to claim 1, wherein said polymer exhibiting a high affinity for said dye is polyvinyl chloride, a copolymer of vinyl chloride with vinyl acetate, or a polyester.

5. An image-receiving element comprising:

(1) a substrate;

(2) an open cell porous film laminated on the surface of said substrate and formed of a material exhibiting a very low affinity for dye;

(3) polyvinyl chloride exhibiting a high affinity for dye, having a plasticizer content of not less than 5% and not more than 40% based on the total weight of dye-receiving element, and filling the pores of said porous film; and (4) a dye image distributed on said surface of said substrate.

6. An image-receiving element according to claim 5 wherein said material exhibiting a very low affinity for said dye is a polyolefin.

7. An imaging system comprising a dye-donor element and an image-receiving element, said image-receiving element comprising:

(1) a substrate;

(2) an open cell porous film laminated on the surface of said substrate and formed of a material exhibiting a very low affinity for dye; and (3) a polymer exhibiting a high affinity for dye, possessing a glass transitition temperature point of not lower than −5° C. and not higher than 40° C., and filling the pores of said porous film.

8. An imaging system according to claim 7, wherein said material exhibiting a very low affinity for said dye is a polyolefin.

9. An imaging system according to claim 8, wherein said polymer exhibiting a high affinity for said dye is polyvinyl chloride, a copolymer of vinyl chloride with vinyl acetate, or a polyester.

10. An imaging system according to claim 7, wherein said polymer exhibiting a high affinity for said dye is polyvinyl chloride, a copolymer of vinyl chloride with vinyl acetate, or a polyester.

11. An imaging system comprising a dye-donor element and an image-receiving element, said image-receiving element comprising:

(1) a substrate;

(2) an open cell porous film laminated on the surface of said substrate and formed of a material exhibiting a very low affinity for dye; and (3) polyvinyl chloride exhibiting a high affinity for dye, having a plasticizer content of not less than 5% and not more than 40% based on the total weight of dye-receiving element, and filling the pores of said porous film.

12. An imaging system according to claim 11, wherein said material exhibiting a very low affinity for said dye is a polyolefin.

* * * * *

UNITED STATES PATENT AND TRADEMARK OFFICE

CERTIFICATE OF CORRECTION

PATENT NO. : 5,411,930

DATED : May 2, 1995

INVENTOR(S) : Mizobuchi

It is certified that error appears in the above-indentified patent and that said Letters Patent is hereby corrected as shown below:

Column 5, line 7, delete "UUshio" and insert --Ushio--.

Signed and Sealed this

Twenty-ninth Day of August, 1995

*Attest:*

Bruce Lehman

BRUCE LEHMAN

*Attesting Officer*

*Commissioner of Patents and Trademarks*